US007142955B1

(12) United States Patent
Kern et al.

(10) Patent No.: US 7,142,955 B1
(45) Date of Patent: Nov. 28, 2006

(54) SYSTEMS AND METHODS FOR CONTROL OF MULTIPLE ENGINE MARINE VESSELS

(75) Inventors: Scott L. Kern, Perkasie, PA (US); Howard A. Lang, Dresher, PA (US); James W. Zecca, Telford, PA (US); Ronald J. List, Bradenton, FL (US)

(73) Assignee: Teleflex, Inc., Plymouth Meeting, PA (US)

( * ) Notice: Subject to any disclaimer, the term of this patent is extended or adjusted under 35 U.S.C. 154(b) by 145 days.

(21) Appl. No.: 10/610,691

(22) Filed: Jun. 30, 2003

(51) Int. Cl.

| | |
|---|---|
| ***B60L 3/00*** | (2006.01) |
| ***G05D 1/00*** | (2006.01) |
| ***B63H 21/21*** | (2006.01) |
| ***B60W 10/04*** | (2006.01) |

(52) U.S. Cl. ..... 701/21; 701/36; 440/84; 440/86

(58) Field of Classification Search ..... 701/21, 701/36; 440/84, 86, 87; 477/480 B, 473.1
See application file for complete search history.

(56) References Cited

U.S. PATENT DOCUMENTS

| | | | | |
|---|---|---|---|---|
| 4,836,809 | A | 6/1989 | Pelligrino | 440/2 |
| 4,898,045 | A | 2/1990 | Baba | 74/471 R |
| 5,336,120 | A * | 8/1994 | Maurer et al. | 440/84 |
| 6,273,771 | B1 | 8/2001 | Buckley et al. | 440/84 |
| 6,280,269 | B1 * | 8/2001 | Gaynor | 440/84 |
| 6,293,838 | B1 * | 9/2001 | Ferguson | 440/84 |
| 6,382,122 | B1 * | 5/2002 | Gaynor et al. | 114/144 RE |
| 6,511,354 | B1 * | 1/2003 | Gonring et al. | 440/87 |
| 6,587,765 | B1 | 7/2003 | Graham et al. | 701/21 |
| 6,751,533 | B1 * | 6/2004 | Graham et al. | 701/21 |
| 6,840,888 | B1 * | 1/2005 | Winquist et al. | 477/83 |

OTHER PUBLICATIONS

Barron, J., "Propulsion, Get on the Bus," *Trailer Boats Magazine*, Jun. 2000, p. 36.
*Boating Magazine*, "Know it by Chart," May 2000, p. 100.
*Boating Industry International*, "Gains in technology will alter makeup of the [title text missing]; New standard being developed for electronic equipment installation; Technicians' revenue may be hurt by advancements in system technology," Nov. 2000, 41-47.
Declaration Pursuant to 37 C.F.R. § 1.56 executed and dated May 15, 2000 with attached Exhibit A, 29 pages.
Denn, J., "Future boat sales will hinge on technology," *Boating Industry International*, Nov. 2000, p. 40.
Hemmel, J., "Information, Please, The digital boating revolution begins," *Boating Magazine*, Sep. 2000, 1 page.
Kelly, C., "Electronics—Can We Talk?," *Power & Motoryact*, Jun. 2000, 36-37.
*Motorboating*, "Plug and Play," Dec. 2000, p. 57.

* cited by examiner

*Primary Examiner*—Thomas Black
*Assistant Examiner*—Brian J. Broadhead
(74) *Attorney, Agent, or Firm*—Baker & Hostetler LLP

(57) ABSTRACT

A control system for a marine vessel having three or more engines is disclosed. The three or more engines may be operated via one or two control levers from each of one or more control stations. The control system may include a first control lever and a second control lever, each of which has an associated operating range. The control levers operate the engine throttle and transmission controls for three or more engines in a plurality of modes. This may be accomplished under software control using a digital data link between respective engine control units associated with the engines.

12 Claims, 11 Drawing Sheets

| LEVER POSITION | THROTTLE | SHIFT POSITION | V | COUNTS | PERCENT OF RANGE |
|---|---|---|---|---|---|
| 1 | FULL | R | $V_1$ | $N_1$ | 100 |
| 2 | IDLE | R | $V_\alpha$ | $N_\alpha$ | 0 |
| 3 | IDLE | N | $V_\beta$ | $N_\beta$ | 0 |
| 4 | IDLE | F | $V_\gamma$ | $N_\gamma$ | 0 |
| 5 | FULL | F | $V_2$ | $N_2$ | 100 |

FIG. 7

SYSTEMS AND METHODS FOR CONTROL OF MULTIPLE ENGINE MARINE VESSELS

CROSS-REFERENCE TO RELATED APPLICATIONS

The subject matter disclosed herein is related to the subject matter disclosed in U.S. patent application Ser. No. 09/874,545, filed Jun. 4, 2001, entitled "Electronic Control Systems For Marine Vessels." The subject matter disclosed in U.S. patent application Ser. No. 09/874,545 is hereby incorporated herein by reference.

FIELD OF THE INVENTION

This invention relates to control systems for marine vessels. More particularly, the invention relates to electronic control systems for marine vessels having three or more engines that can be operated via one or two control levers from each of one or more helm stations.

BACKGROUND OF THE INVENTION

Twin engine marine vessels typically use one of three approaches to control transmission and throttle. In a first approach, a control head is provided that includes two control levers, each of which is adapted to control shift and throttle of an associated engine. In another approach, two, two-lever control heads are provided—one for control of both throttles and the other for control of both transmissions. A third approach provides for a control head having four control levers—one for each throttle and one for each transmission. Recent trends are to the first approach, as it has been found that boaters consider it to be the easiest to operate when running and maneuvering the boat.

Many marine vessels, however, include three or more engines. In marine vessels with three engines, the engines are typically referred to as port, center, and starboard engines. In marine vessels with four engines, the engines are typically referred to as port, center port, center starboard, and starboard engines. Such vessels also include a transmission associated with each engine. An engine/transmission pair is commonly known as a "power train."

Previously known marine vessels with three or more engines typically included one or more control heads having, in combination, one control lever for each engine and one for each transmission. If the vessel included a second helm station, the number of control levers doubled. Thus, with such an approach, operation of a multi-engine vessel is quite different from operation of a two engine vessel. Not only does the sheer number of control levers intimidate some operators, but this solution requires more care to avoid making a mistake at a critical time, and more attention time in routine operation. It would be desirable, therefore, if systems were available to enable an operator to control three or more power trains via no more than two control levers.

SUMMARY OF THE INVENTION

The invention provides systems and methods for controlling a multiple engine marine vessel via one or two control levers from each of one or more helm stations. A control system according to the invention for a marine vessel having three or more engines may include a first control lever having an associated operating range and a second control lever having an associated operating range. Each of the engines is adapted to adjust a respective throttle in response to a movement of at least one of the control levers within its associated operating range. The marine vessel may also include three or more transmissions. Each transmission adjusts a respective shift position in response to a movement of at least one of the control levers.

In a preferred embodiment of the invention, a first engine control unit (ECU) is electrically coupled to the first control lever, the first engine, and the first transmission. A second ECU is electrically coupled to the second control lever, the second engine, and the second transmission. A third ECU is communicatively coupled to the first and second ECUs and electrically coupled to the third engine and the third transmission. The first ECU controls the throttle of the first engine and shift position of the first transmission based on a position of the first control lever within its operating range. The second ECU controls the throttle of the second engine and the shift position of the second transmission based on a position of the second control lever within its operating range. The third ECU controls the throttle of the third engine and the shift position of the third transmission based on information received from at least one of the first and second ECUs. The third ECU may control the throttle of the third engine and the shift position of the third transmission based on at least one of the position of the first control lever and the position of the second control lever.

A control system according to the invention may also include an engine control device operable to selectively engage and disengage any of a plurality of power trains. Such an engine control device may include a plurality of switches, each switch being operable to engage and disengage a respective power train. A plurality of engagement indicators may also be provided, each engagement indicator being associated with a respective power train and indicating whether its associated power train is engaged or disengaged.

BRIEF DESCRIPTION OF THE DRAWINGS

The foregoing summary, as well as the following detailed description of the preferred embodiments, is better understood when read in conjunction with the appended drawing. For the purpose of illustrating the invention, there is shown in the drawing an embodiment that is presently preferred, it being understood, however, that the invention is not limited to the specific methods and instrumentalities disclosed.

FIG. 7 depicts an exemplary lever position conversion table that may be used in accordance with the invention.

DETAILED DESCRIPTION OF ILLUSTRATIVE EMBODIMENTS

Figure 1:
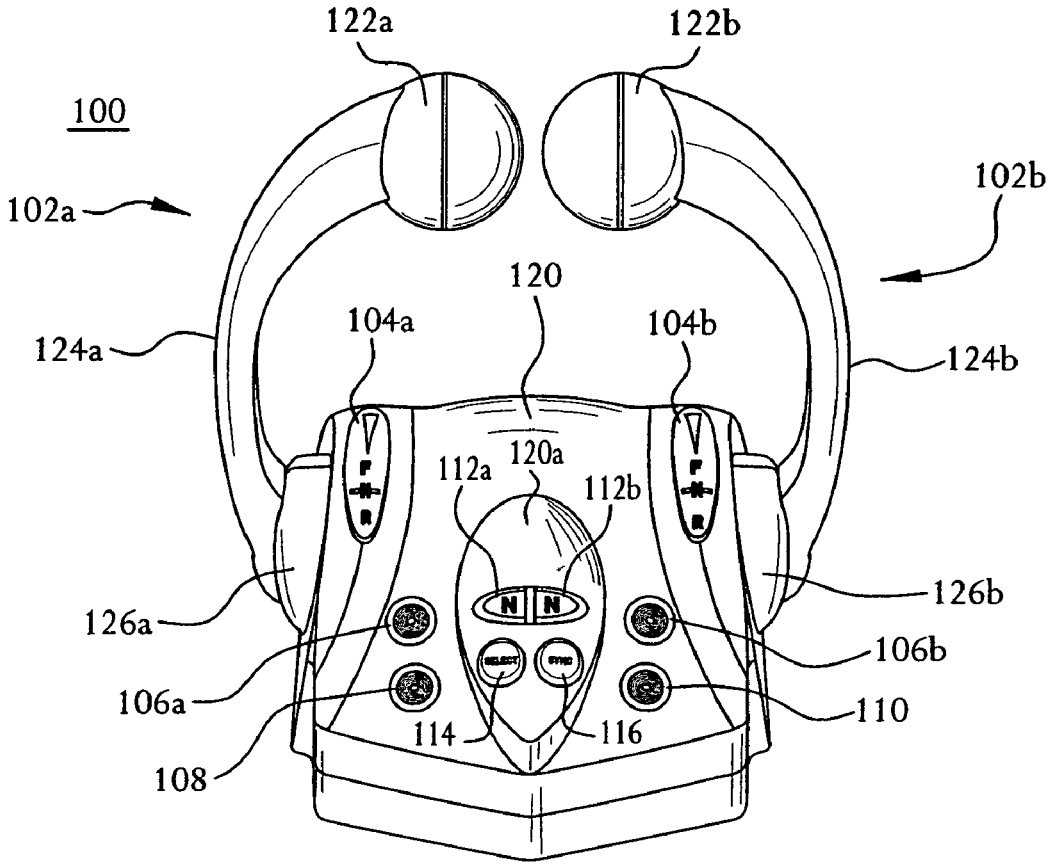
FIG. 1 depicts a preferred embodiment of a control head for use in accordance with the invention.

FIG. 1 depicts a preferred embodiment of a dual, top-mount control head 100 for controlling a marine vessel having a plurality of engines. The control head 100 includes a housing 120, a first control lever 102*a*, and a second control lever 102*b*.

The control lever 102*a* controls the throttle of one or more associated engines (not shown) and the shift position of one or more associated transmissions (not shown). The control lever 102*a* may be rotationally coupled to the housing 120, via a rotational coupling mechanism 126*a*, and may include a control lever knob 122*a* and a control lever handle 124*a*. Similarly, the control lever 102*b* controls the throttle of one or more associated engines (not shown) and the shift position of one or more associated transmissions (not shown). The control lever 102*b* may be rotationally coupled to the housing 120, via a rotational coupling mechanism 126*b*, and may include a control lever knob 122*b* and a control lever handle 124*b*.

The control head 100 also includes a first shift status indicator 104*a*, and a second shift status indicator 104*b*. Each shift status indicator 104*a*, 104*b* indicates the current shift and throttle position of the corresponding control lever 102*a*, 102*b*. Each control lever 102 can be moved through an operational range from reverse wide open throttle to forward wide open throttle (see FIG. 5). By moving a control lever 102 along its operational range, an operator can control the shift position of one or more associated transmissions and the throttle of one or more associated engines.

In a preferred embodiment, the control head 100 also includes a first neutral indicator 106*a*, a second neutral indicator 106*b*, a control head indicator 108, and an engine sync indicator 110. Preferably, the indicators 106*a*, 106*b*, 108, and 110 are light emitting diodes (LEDs). More preferably, the neutral indicators 106*a*, 106*b* are amber LEDs, the control head indicator 108 is a green LED, and the engine sync indicator 110 is a red LED.

The control head 100 may also include a first neutral command input device 112*a*, a second neutral command input device 112*b*, a select command input device 114, and a sync command input device 116. Preferably, the input devices 112*a*, 112*b*, 114, and 116 are buttons, which can be disposed on a face 120*a* of the housing 120 and arranged in the form of a keypad.

Figure 2:
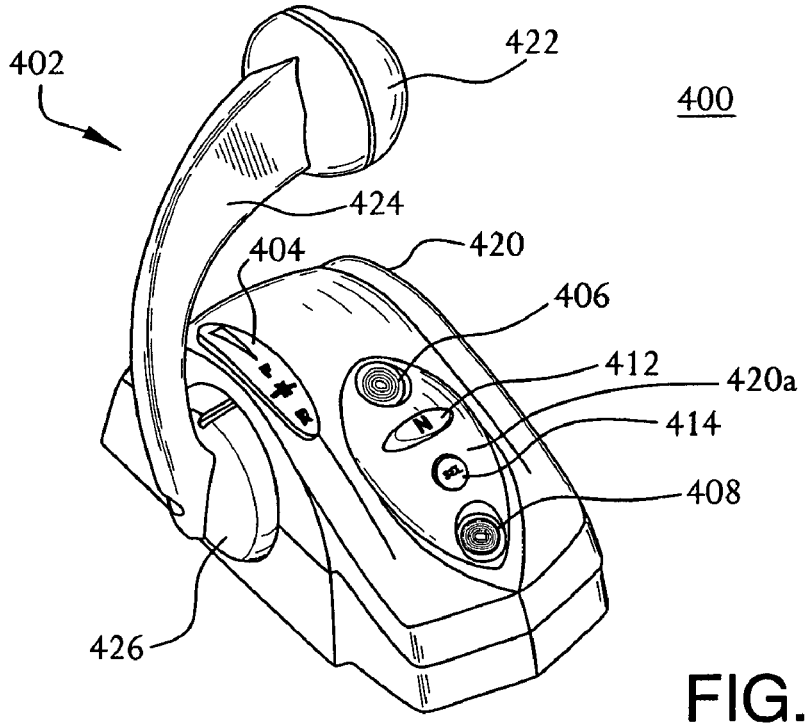
FIG. 2 depicts an alternative embodiment of a control head for use in accordance with the invention.

FIG. 2 depicts a preferred embodiment of a single top mount control head 400 for controlling a marine vessel having one or more engines. The control head 400 includes a housing 420 and an engine control lever 402. The control lever 402 controls the throttle of one or more associated engines (not shown) and the shift position of one or more associated transmissions (not shown). The control lever 402 may be rotationally coupled to the housing 420, via a rotational coupling mechanism 426, and may include a control lever knob 422 and a control lever handle 424.

Preferably, the control head 400 also includes a shift status indicator 404 that indicates the current shift and throttle position of the control lever 402. The control lever 402 can be moved through an operational range from reverse wide open throttle to forward wide open throttle (see FIG. 5). By moving the control lever 402 along its operational range, an operator can control the shift position of one or more associated transmissions and the throttle of one or more associated engines.

In a preferred embodiment, the control head 400 also includes a neutral indicator 406 and a control head indicator 408. Preferably, the neutral indicator 406 is an amber LED, and the control head indicator 408 is a green LED.

The control head 400 can also include a neutral command input device 412, and a select command input device 414. Preferably, the input devices 412 and 414 are buttons, which can be disposed on a face 420*a* of the housing 420 and arranged in the form of a keypad.

Figure 3:
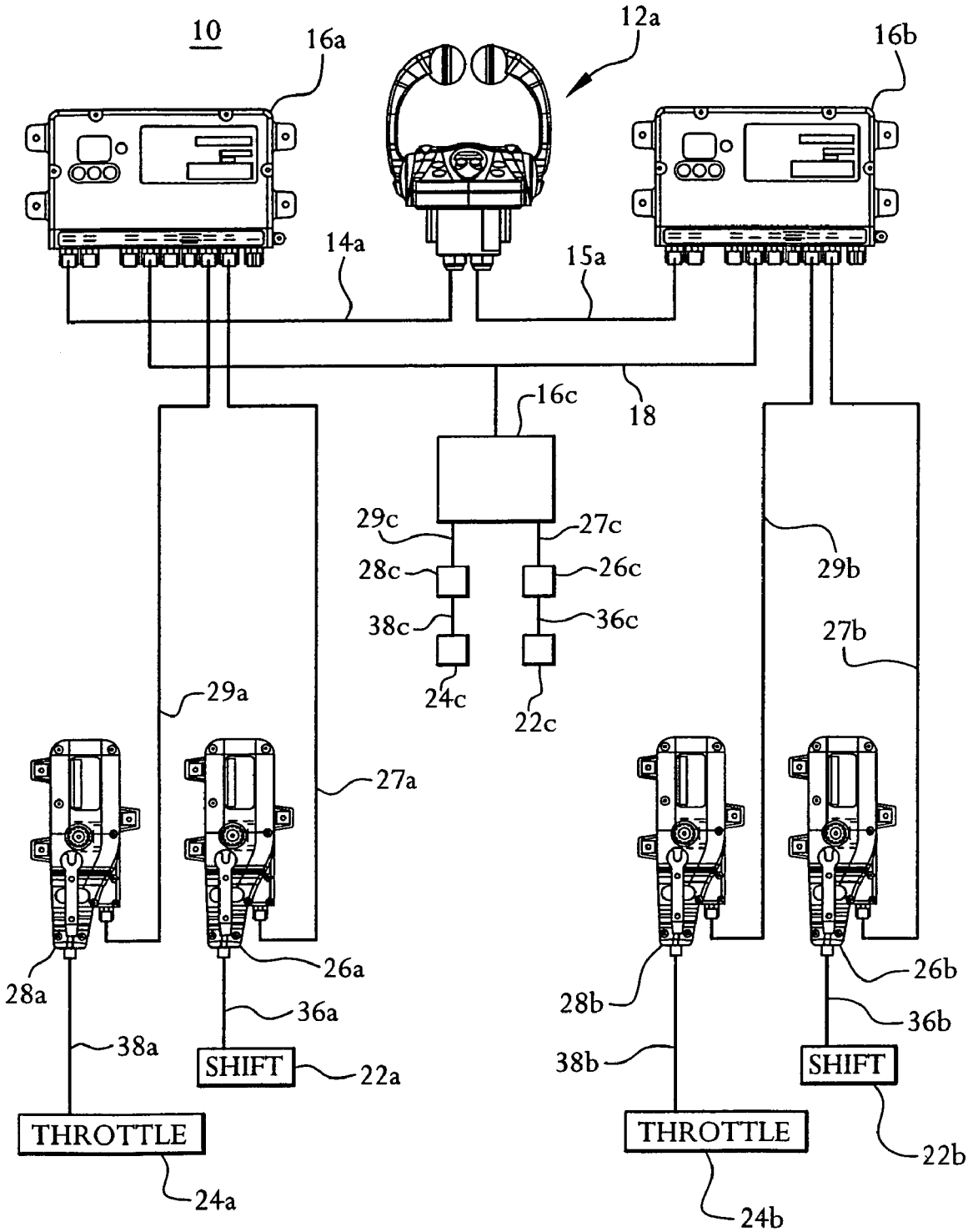
FIG. 3 depicts a preferred embodiment of a control system according to the invention.

FIG. 3 depicts a preferred embodiment of a control system 10 according to the invention. As shown in FIG. 3, the control system 10 includes a control head 12*a*. The control head 12*a* may be, for example, any of the control heads described above in connection with FIGS. 1 and 2.

As shown, the control head 12*a* includes two control levers and is electrically coupled to one or more electronic control units (ECUs) 16*a–c*. Preferably, the control head 12*a* is coupled to the ECUs 16*a*, 16*b* via one or more cables 14*a*, 15*a*. The cables 14*a*, 15*a* contain wires (not shown) that carry electrical signals from the control head 12*a* to the ECUs 16*a*, 16*b*.

The ECUs 16*a–c* are communicatively coupled to one another via a communications link, or harness, 18. Preferably, the communications link 18 is a standard network connection, such as the well-known CANBus. The ECUs 16*a–c* can pass messages to one another via the communications link 18 using a predefined protocol, such as the well-known NMEA 2000 protocol. Though CANBus and NMEA 2000 are provided by way of example, it should be understood that the communications link 18 can be any suitable communications link and can employ any suitable communications protocol.

Each ECU 16*a–c* is electrically connected to a corresponding shift actuator 26*a–c* via a respective electrical path 27*a–c*, and to a corresponding throttle actuator 28*a–c* via a respective electrical path 29*a–c*. Preferably, each of the electrical paths 27*a–c*, 29*a–c* comprises a cable that contains a pair of conductive leads that provide actuator drive current from a power supply in the ECU 16*a–c* to a direct current (DC) motor in the actuator 26*a–c*, 28*a–c*, and an electrical conductor that carries actuator rod position feedback signals to the ECU 16*a–c* from a rod position sensor in the actuator 26*a–c*, 28*a–c*.

Each shift actuator 26*a–c* is electro-mechanically coupled, via a shift actuator rod 36*a–c*, to a corresponding transmission 22*a–c*. Each shift actuator 26*a–c* actuates the shift position of the corresponding transmission 22*a–c* by moving the actuator rod 36*a–c* into one of a number of predefined positions. Similarly, each throttle actuator 28*a–c* is electro-mechanically coupled, via a throttle actuator rod 38*a–c* to a corresponding engine 24*a–c*. Each throttle actuator 26*a–c* actuates the throttle of the corresponding engine 24*a–c* by moving the actuator rod 38*a–c* into one of a number of predefined positions. Thus, the control head 12*a* can be operatively coupled to each of a plurality of transmissions 22*a–c* and engines 24*a–c*.

Though the control system 10 depicted in FIG. 3 includes one control head 12*a*, three transmissions 22*a–c*, and three engines 24*a–c*, it should be understood that a control system according to the invention may include any number of control heads, transmissions, and engines, depending on the requirements of the particular installation.

Figure 4A:
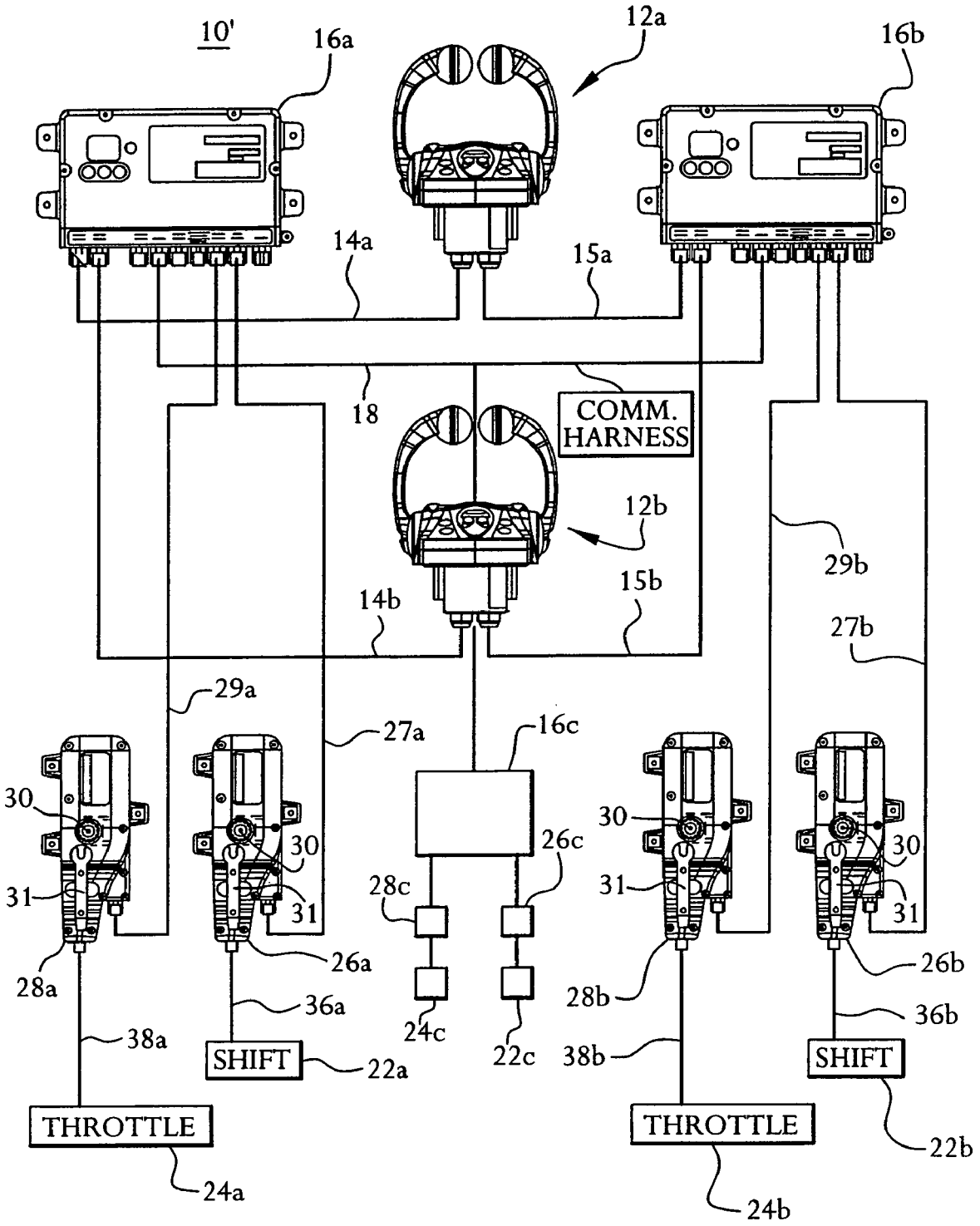
FIGS. 4A–4C depict alternate preferred embodiments of a control system according to the invention.

For example, as shown in FIG. 4A, a control system 10' may include two (or more) control heads 12*a–b* operatively coupled to the ECUs 16*a–c*. The ECUs 16*a–c* may be coupled to respective transmissions 24*a–c* and engines 22*a–c*.

Figure 4B:
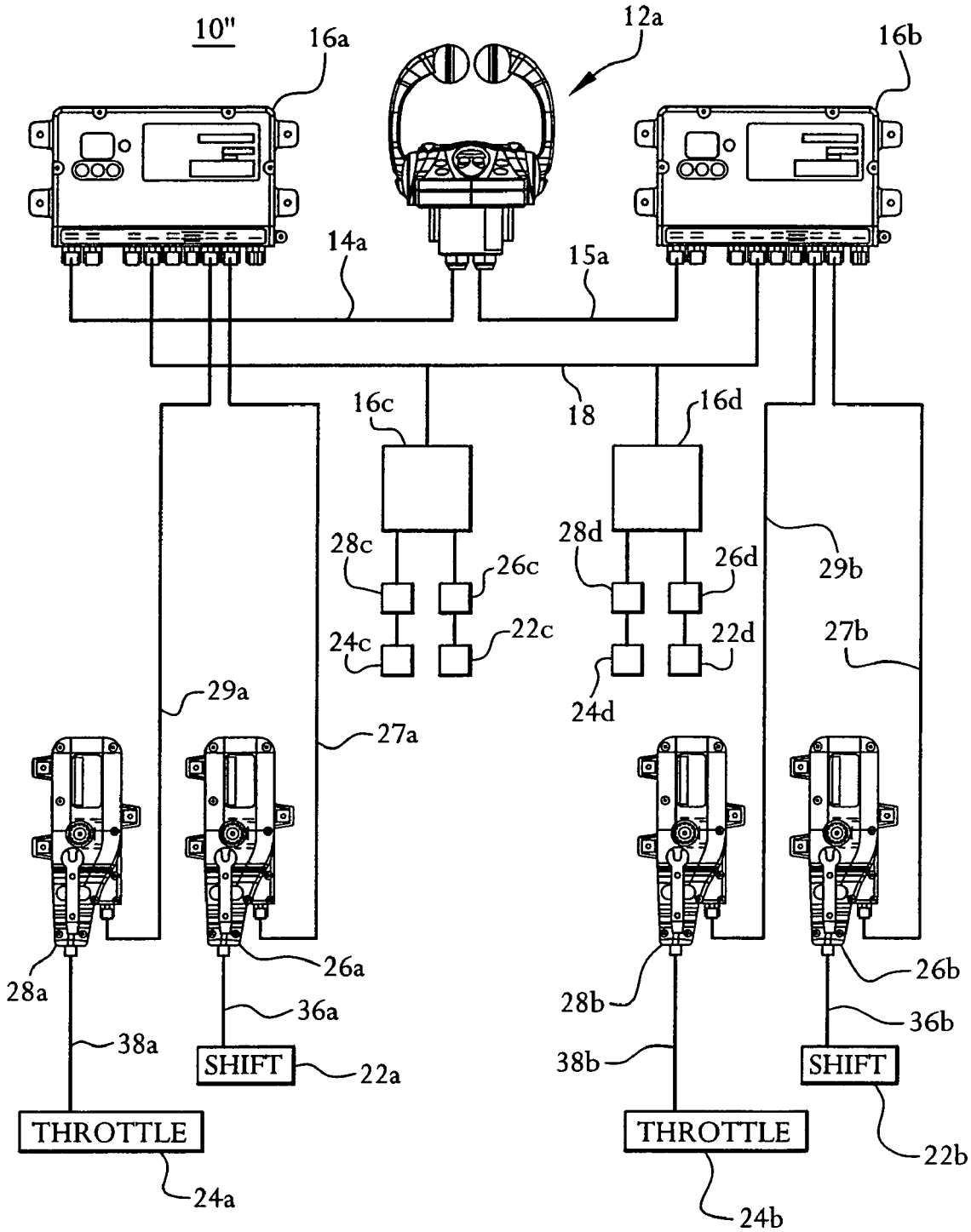

As shown in FIG. 4B, a control system 10" may include a control head 12*a* operatively coupled to respective ECUs

16*a–d*. The ECUs 16*a–d* may be coupled to respective transmissions 24*a–d* and engines 22*a–d*.

Figure 4C:
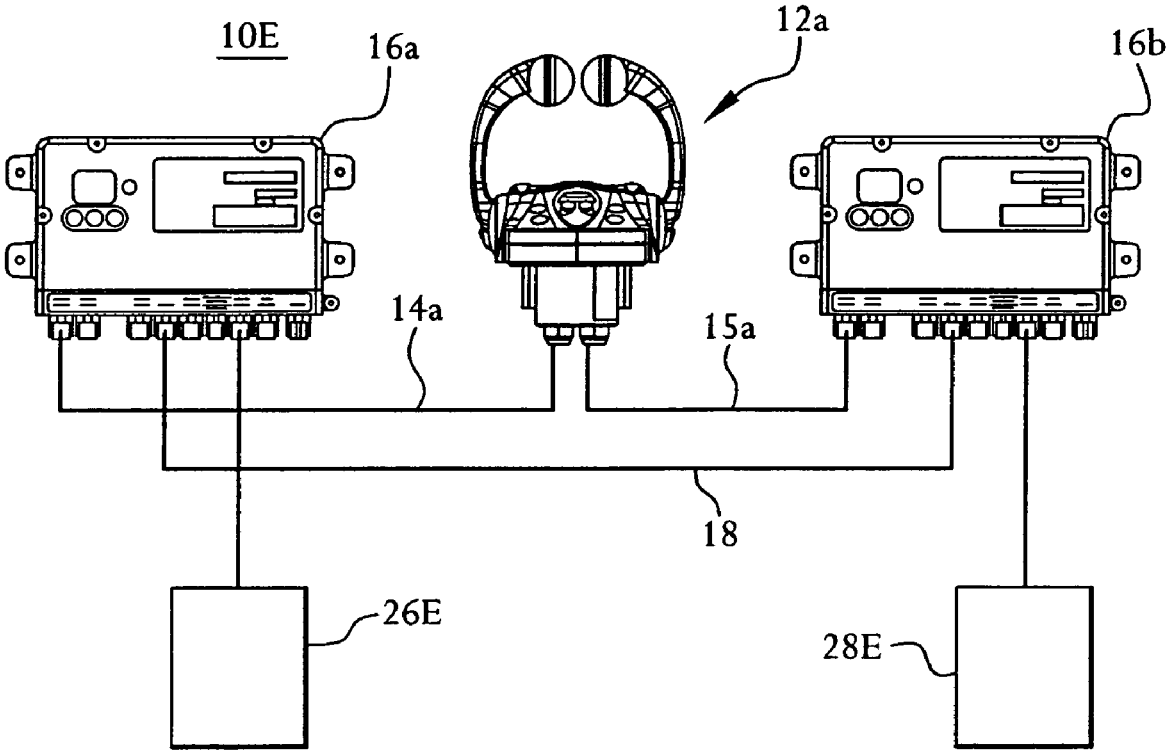

FIG. 4C depicts a control system 10E in which the marine vessel includes fully electronic power trains 26E, 28E. In such an embodiment, an ECU may be electrically coupled directly to its associated engine/transmission without the need for intervening actuators to move the actuator rods. The ECU 16*a*, 16*b* may control shift/throttle by providing the power train 26E, 28E, with analog voltage signals or digital data packets.

Figure 5:
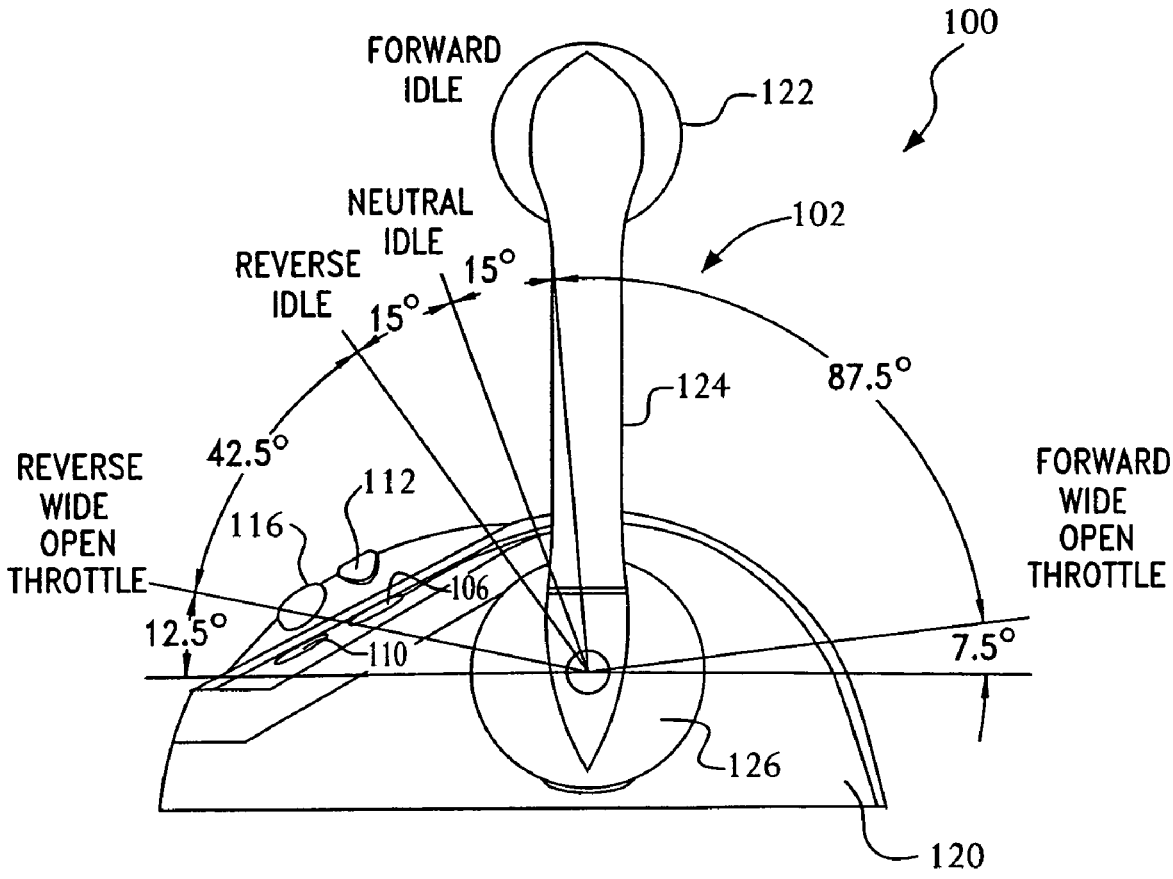
FIG. 5 depicts an exemplary operating range for a typical control lever.

To operate the vessel, the operator can move a control lever through its operating range from reverse wide open throttle to forward wide open throttle. FIG. 5 depicts an exemplary operating range for a typical control lever. Preferably, the control lever 102 has an operational range of approximately 160 degrees (though it should be understood that the actual operating range of the control lever 102 may extend over any number of degrees). That is, in a preferred embodiment, the operator can move the control lever 102 through 160 degrees from a reverse wide open throttle position to a forward wide open throttle position.

Preferably, as shown in FIG. 5, a reverse wide open throttle position exists at 12.5 degrees, a reverse idle position exists at 55 degrees, a neutral idle position exists at 70 degrees, a forward idle position exists at 85 degrees, and a forward wipe open throttle position exists at 172.5 degrees from the horizontal. The operator can vary forward throttle between forward idle and forward wide open throttle by moving the control lever 102 between 85 degrees and 172.5 degrees. Similarly, the operator can vary reverse throttle between reverse idle and reverse wide open throttle by moving the control lever 102 between 55 degrees and 12.5 degrees. It should be understood that these positions are purely exemplary and may be varied as desired for any specific embodiment of the invention.

Preferably, the control head includes a catch (not shown) at each of the aforementioned points along its operational range. In this way, an operator can detect by sense of feeling that the control lever 102 has moved into a new shift/throttle position. Also, in a preferred embodiment, the control head includes respective mechanical stops (not shown) at the forward wide open throttle and reverse wide open throttle positions to prevent the operator from moving the control lever 102 outside its operational range.

Figure 6:
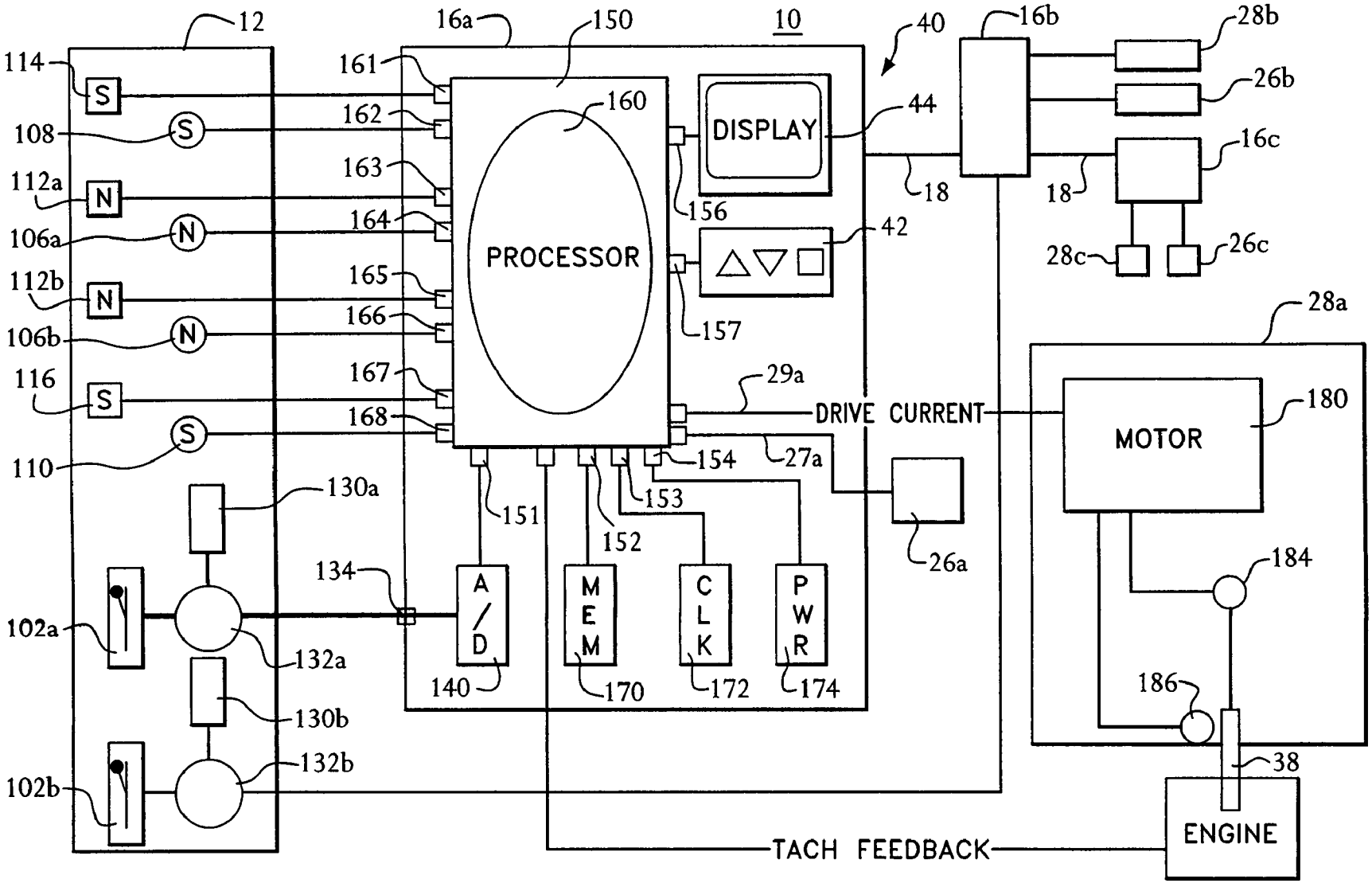
FIG. 6 is a block diagram of a preferred embodiment of a control system according to the invention.

FIG. 6 is a block diagram of an embodiment of a control system 10 according to the invention including a control head 12, three ECUs 16*a–c*, shift actuators 26*a–c*, and throttle actuators 28*a–c*. For the sake of brevity, ECU 16*a* and throttle actuator 28*a* are described in detail, though it should be understood that ECUs 16*b–c*, and actuators 26*b–c* and 28*b–c* may be similarly made and used.

The control head 12 includes a first (e.g., port) control lever 102*a*, a second (e.g., starboard) control lever 102*b*, a first (e.g., port) control lever position sensor 132*a*, and a second (e.g., starboard) control lever position sensor 132*b*. Each of the control lever position sensors 132*a–b* may include a respective potentiometer, for example, or other such device that senses the current position of the corresponding control lever within its operating range. It should be understood that a potentiometer is merely an example of a position sensing device and that other position sensors, such as Hall effect sensors, for example, may be used to sense the position of the control lever.

The position sensor 132*a* is electrically connected to an input pin 134 of the ECU 16 via an electrical conductor, such as a wire. The power supply 174 in the ECU provides an electrical signal to the position sensor 132*a*. In a preferred embodiment, the power supply is a 5 volt power supply. The position sensor 132*a* causes the voltage of the electrical signal to vary as the control lever 102*a* moves within its operating range. Preferably, the potentiometer voltages indicating lever position are calibrated uniquely with the ECU to which it is electrically connected. The potentiometer provides a variable resistance that causes the voltage of the electrical signal to vary linearly from a first voltage, $V_1$, when the control lever 102*a* is in at its reverse wide open throttle position, to a second voltage, $V_2$, when the control lever 102*a* is at its forward wide open throttle position. Thus, the voltage of the electrical signal out of the potentiometer, which is forwarded to the input pin 134 of the ECU 16*a*, represents the position of the control lever 102*a* within its operating range.

The ECU 16*a* includes an analog-to-digital (A/D) convertor 140 that receives and digitizes the electrical signal from the control head 12. Preferably, the A/D converter 140 is a 10 bit A/D converter that provides a discrete value, ranging from 0 to 1023, that represents the voltage of the received signal. In such an embodiment, a reference voltage (e.g., 5V) can be divided into 1024 discrete values or "counts." The voltage signal out of the potentiometer can then be converted into a count, which can then be converted into percent of full throttle.

The output of the A/D converter 140 is electrically connected to an input pin 151 of a host processor 150. The host processor 150, which is preferably an embedded microcontroller, hosts control software 160 that controls the ECU 16*a*. The A/D converter 140 outputs the current count to the host processor 150. As described in detail below, the ECU 16*a* controls the shift position of the transmission and throttle of the engine based on the current count (which represents the current position of the control lever).

The control head 12 also includes a first (e.g., port) engine neutral indicator 106*a*, a second (e.g., starboard) engine neutral indicator 106*b*, a select indicator 108, and a sync indicator 110. Each of the indicators is electrically connected to a respective output pin 162, 164, 166, 168 of the ECU's processor 150 via a corresponding wire or other such electrical conductor. Preferably, the indicators 106*a*, 106*b*, 108, and 110 are light emitting diodes (LEDs). More preferably, the engine neutral indicators 106*a*, 106*b* are amber LEDs, the control head indicator 108 is a green LED, and the engine sync indicator 110 is a red LED. Electrical signals output from the ECU 16*a* cause the LEDs to light.

The control head 12 also includes a first (e.g., port) neutral command input device 112*a*, a second (e.g., starboard) neutral command input device 112*b*, a select input device 114, and a sync input device 116. Preferably, each of the input devices 112*a*, 112*b*, 114, and 116 is a button that is electrically connected to a respective input pin 161, 163, 165, 167 of the ECU 16*a* via a wire or other such electrical conductor. Each time a button is pushed, it generates an electrical signal, or impulse, that is forwarded to the ECU 16*a*.

The ECU 16*a* also includes an operator interface 40 that includes a data input device 42, via which an operator can input data to the ECU 16*a*, and a display or other data output device 44 via which the ECU 16*a* can provide information to the operator. The data input device 42 is electrically connected to an input pin 157 of the host processor 150. As shown, the data input device 42 can include one or more buttons or keys. The data output device 44 can be an LCD display, for example. The data output device 44 is electrically connected to an output pin 156 of the host processor 150.

Preferably, the ECU 16*a* includes a memory 170, a clock 172, and a power supply 174. Preferably, the memory 170 is electrically connected to an input/output pin 152 of host processor 150. Preferably, the clock 172 is a crystal controlled device that is electrically connected to an input pin 153 of host processor 150. Preferably, the power supply 174 is a 12V power supply that is electrically connected to an input pin 154 of host processor 150.

Where present, a typical actuator 28*a* includes an electrical motor 180, an actuator rod 38*a*, an electromechanical rod positioning device 184, and a rod position sensor 186. The motor 180 can be a servo-driven motor, for example, such as a DC permanent magnet type. The ECU's power supply is electrically connected to the actuator's motor via a pair of electrically conductive leads. The ECU 16*a* drives the motor 180 by providing a current to the motor. The current, which, preferably, is provided as a series of pulses, has an average duty cycle that the ECU 16*a* can vary, thereby varying the amount of power that the ECU 16*a* supplies to the motor 180.

The motor 180 is electrically coupled to the rod positioning device 184, which is mechanically coupled to the actuator rod 38*a*. The motor 180 provides electrical power to the rod positioning device 184, which moves the actuator rod 38*a* accordingly. The rod positioning device 184 can include a gear train, such as a worm gear, for example, that is driven by the motor 180, and is coupled to a push/pull cable that provides linear motion to the actuator rod 38*a*.

The actuator rod 38*a* has a range of movement. Preferably, a throttle actuator rod can be set to a first position that corresponds to wide open throttle, a second position that corresponds to fully closed throttle, or, in general, any position in between. As the rod is moved within its range of movement, the throttle opens or closes accordingly. Similarly, a shift actuator rod can be set to a first position that corresponds to reverse, a second position that corresponds to neutral, and a third position that corresponds to forward. Preferably, the position of an actuator rod is expressed in terms of the percent of the actuator rod's range of movement. For example, a throttle actuator rod can be set at 0% of its range of movement for wide open throttle, and at 100% of its range of movement for fully closed throttle. Similarly, a shift actuator rod can be set at 0% of its range of movement for reverse, 50% for neutral, and 100% for forward.

The ECU controls the shift position of the transmission and throttle of the engine based on the current position of the control lever. The ECU receives the electrical signal from the control head and determines, based on the voltage level of the signal, whether to vary throttle or shift position. From the voltage level of the received signal, the ECU determines the current position of the control lever. From the current position of the control lever, the ECU determines what shift/throttle information should be sent to the engine/transmission, or, where actuators are present, the positions to which the shift and throttle actuator rods should be set.

The ECU's memory may contain a conversion table from which the ECU can determine the position to which an actuator rod should be set based on the position of the control lever. An exemplary conversion table is depicted in FIG. 7. In a preferred embodiment, the operating range of the control lever is divided into a number discrete sub-ranges, or sectors. Each sector corresponds to a count, as described above. Thus, each time the control lever moves from a first sub-range into a second sub-range, the voltage of the electrical signal into the A/D convertor changes by one discrete voltage leap. The count out of the A/D convertor varies accordingly. Thus, the current position of the control lever is mapped to a count. For example, when the control lever is at its reverse wide open throttle position, the control head provides to the A/D an electrical signal having a voltage of $V_1$, and the A/D outputs a count of $N_1$.

Where actuators are present, each count between reverse wide open throttle and forward wide open throttle may also correspond to a predefined position of the actuator rod. Thus, as the operator moves the control lever through its operating range, the voltage of the electrical signal that is sent to the ECU varies. For shift position, the ECU determines from the current count whether the control lever is in a reverse position (i.e., within the reverse sub-range of the control lever's operating range), a neutral position, or a forward position. The ECU then causes the shift actuator rod to be set to the appropriate position as described above. As for throttle, the ECU determines the percent of the throttle actuator from the current count, and causes the throttle actuator rod to be moved into a position that corresponds to that percentage of its range of movement.

According to the invention, the control system enables an operator to control three or more power trains via one or two control levers from each of one or more control stations. In a preferred embodiment of a three engine system, the operator can control both the port and center engines via the port control lever. In a preferred embodiment of a four engine system, the operator can control both the port and center port engines via the port control lever and both the starboard and center starboard engines via the starboard control lever.

In a three engine system, the port control lever controls the shift positions of the port and center transmissions, as well as the throttle of the port and center engines, based on the current position of the port control lever within its operating range.

To control the shift positions of the port and center transmissions, the port ECU determines whether the port control lever is in a reverse, neutral, or forward position. The port ECU causes the port transmission to assume (i.e., move into or remain in) the corresponding shift position, and communicates the current shift position to the center ECU via the communications link. The center ECU receives the shift position data and causes the center transmission to assume its corresponding shift position. Thus, the port and center transmissions can be controlled from a single control lever.

To control the throttle positions of the port and center engines, the port ECU determines the current percent of throttle based on the current position of the port control arm as described above. The port ECU communicates its current percent of throttle to the center ECU, which, in turn, commands the center engine to achieve the same percent of throttle.

In a four engine embodiment, the port control lever may be used to control the port and center port engines as described above. Similarly, the starboard control lever may be used to control the starboard and center starboard engines.

Preferably, the control system also enables the operator to enter an optional "sync" mode wherein the operator can control all engines from a single control lever. To place the system into sync mode, the operator enters a sync command (e.g., by pushing the "sync" button) at the control head. In response, the sync status indicator provides an indication that the system is now ready to go into sync mode. For example, in an embodiment wherein the sync status indicator is an LED, the LED can be made to flash. To enter sync mode, the operator must then match the lever position of the control levers. Preferably, the levers are considered matched when they are within 10 percent of each other. When the levers are matched, the system is placed into sync mode, and a master control lever (e.g., the port control lever) now controls the plurality of engines. The sync status indicator provides an indication that the system is in sync mode. For example, in an embodiment wherein the sync status indicator is an LED, the LED can be made to light and remain lit.

While in sync mode, the master control lever controls the shift positions of three or more transmissions and the throttles of three or more engines based on the current position of the master control lever.

To control the shift positions of the plurality of transmissions, the master ECU (i.e., the ECU associated with the maser control lever) determines whether the master control lever is in a reverse, neutral, or forward position. The master ECU causes the master transmission to assume the corresponding position, and communicates the current shift position to the slave ECUs (i.e., the ECUs associated with the other engines) via the communications link. The slave ECUs receive the shift position data and cause their respective transmissions to assume the position. Thus, a plurality of transmissions may be controlled from a single lever.

Preferably, a control system according to the invention includes a multi-stage engine synchronization algorithm that is designed to provide the slave engines with smooth responses to changes in the master engine's throttle. Ideally, the control system is designed to keep both engines in as near to perfect synchronization as possible at all times (to keep the vessel from vacillating from side to side as it moves forward, for example). Ideally, the control system is designed to keep both engines in as near to perfect synchronization as possible at all times. In practice, however, the engines will likely be somewhat out of sync as the operator varies throttle via the port control arm. This effect is typically caused because of delays in commanding the center engine into the same throttle position as the port engine. A multi-stage synchronization algorithm is described in detail in U.S. patent application Ser. No. 09/874,545.

To exit sync mode, the operator enters a second sync command at the control station. In response, the sync status indicator provides an indication that the system is now ready to exit sync mode. For example, the LED flashes. To exit sync mode, the operator matches the control levers. In response, the system is no longer in sync mode, and the sync status indicator provides an indication that the system is no longer in sync mode. For example, the LED is turned off and remains unlit. After the system is removed from sync mode, each control lever will control its respective engine(s) as described above.

Preferably, the operator can activate split range throttle and programmable idle while in power train sync mode. Split range throttle and programmable idle are described in detail in U.S. patent application Ser. No. 09/874,545. Preferably, if either the split range throttle or programmable idle capability is activated while the system is in sync mode, the capability will remain activated even after the system exits sync mode. However, if either the split range throttle or programmable idle capability is activated while the system is not in sync mode, it is preferred the system not be placed into sync mode.

In still another embodiment of the invention, power train synchronization can be achieved through "engine synchronization." In this embodiment, the slave engines are controlled not by the position of the master lever, but by monitoring the current throttle rate of the master engine. That is, the master engine communicates its current throttle to the master ECU, which communicates the throttle information to the slave ECUs. Engine synchronization is described in detail in U.S. patent application Ser. No. 09/874,545.

For safety reasons, in an installation having more than one control station it is preferred that only one control station is capable of controlling the operation of the marine vessel at any given time. On occasion, however, the operator desires to transfer control from one control station to another. Preferably, the operator can initiate such a transfer of control regardless of the current throttle rate or shift position. Station transfer techniques are described in detail in U.S. patent application Ser. No. 09/874,545.

Under certain circumstances (most notably when docking the vessel), the port and starboard transmissions may be in different gears (e.g., the port transmission may be in reverse while the starboard transmission is in forward). In an installation with more than two engines (and particularly in a three engine installation), it may be desirable for a center engine to behave a certain way depending on the current gear positions of the port and starboard transmissions. Accordingly, a control system of the invention preferably provides a set of "docking modes." FIGS. 8A–8D provide flowcharts of exemplary docking modes.

Figure 8A:
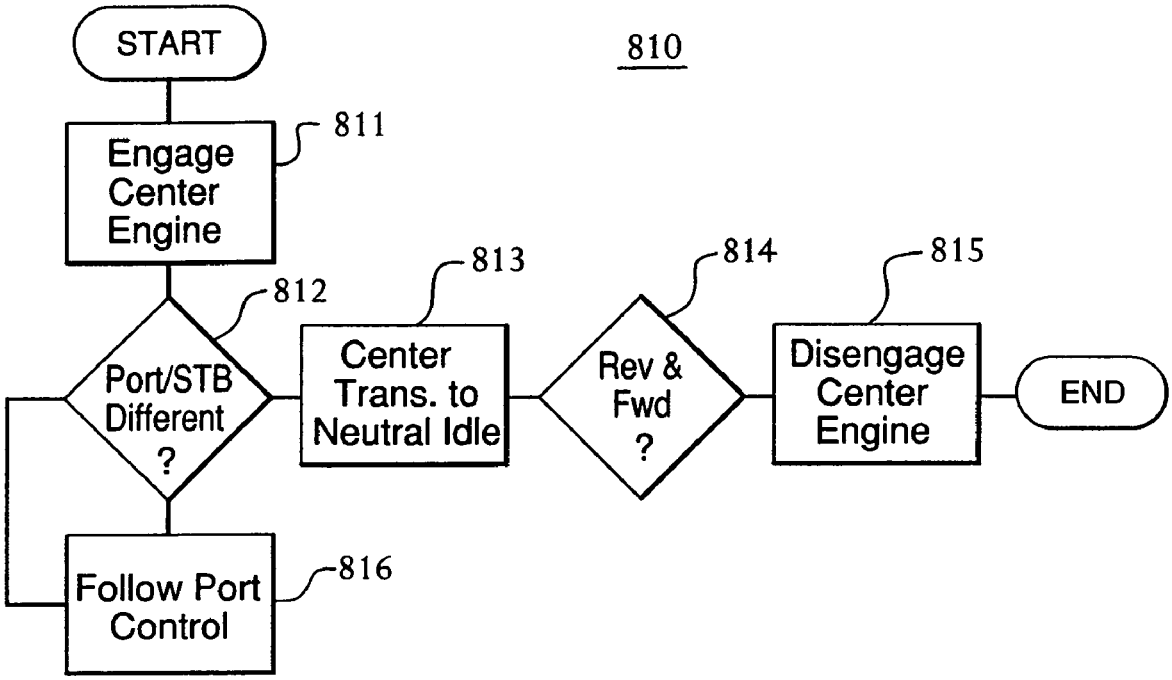
FIGS. 8A–8D are flowcharts of docking modes according to an aspect of the invention.

In a first docking mode 810, as depicted in FIG. 8A, the center ECU causes the center engine to engage at startup (step 811). If, at step 812, the center ECU detects that the port and starboard transmissions are in different gears, then, at step 813, the center ECU causes the center transmission moves to neutral idle. If, at step 814, the center ECU detects that the port transmission is in forward and the starboard transmission is in reverse (or vice versa), then, at step 815, the center ECU automatically disengages the center transmission. Otherwise, at step 816, the center ECU causes the center engine to follow the port lever for shift and throttle position as long as the port transmission and starboard transmission are in the same gear.

Figure 8B:
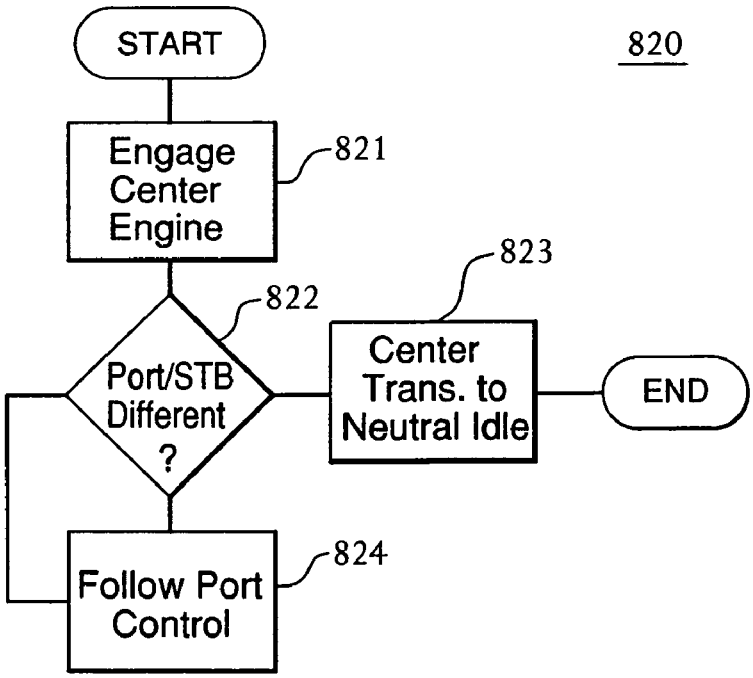

In a second docking mode 820, as depicted in FIG. 8B, the center ECU causes the center engine to engage at startup (step 821). If, at step 822, the center ECU detects that the port and starboard transmissions are in different gears, then, at step 823, the center ECU causes the center transmission to move to neutral idle. Otherwise, at step 824, the center ECU causes the center engine to follow the port lever for shift and throttle position as long as the port transmission and starboard transmission are in the same gear.

Figure 8C:
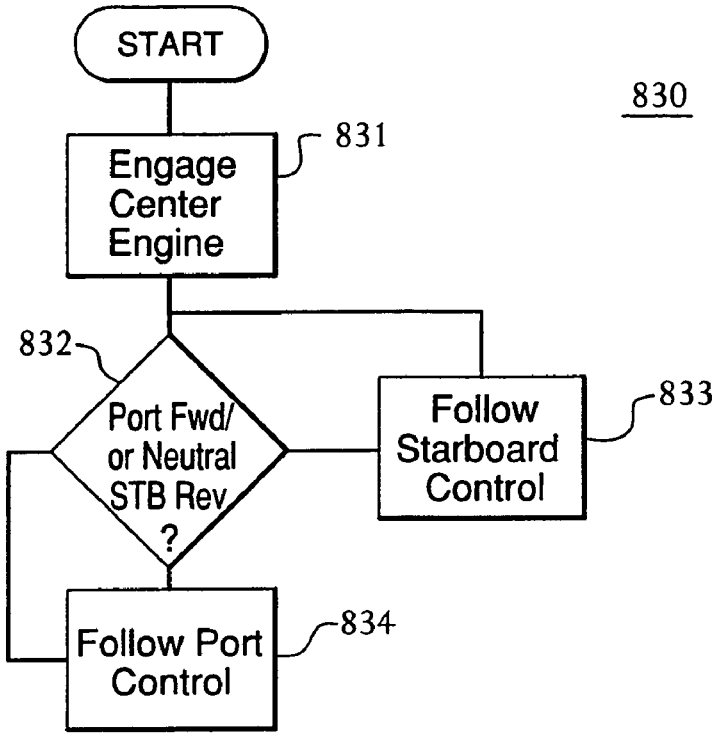

In a third docking mode 830, as depicted in FIG. 8C, the center ECU causes the center engine to engage at startup (step 831). If, at step 832, the center ECU detects that the starboard transmission is in reverse and the port transmission is not, then, at step 833, the center ECU causes the center engine to follow the starboard lever for shift and throttle position. Otherwise, at step 834, the center ECU causes the center engine to follow the port lever for shift and throttle position.

Figure 8D:
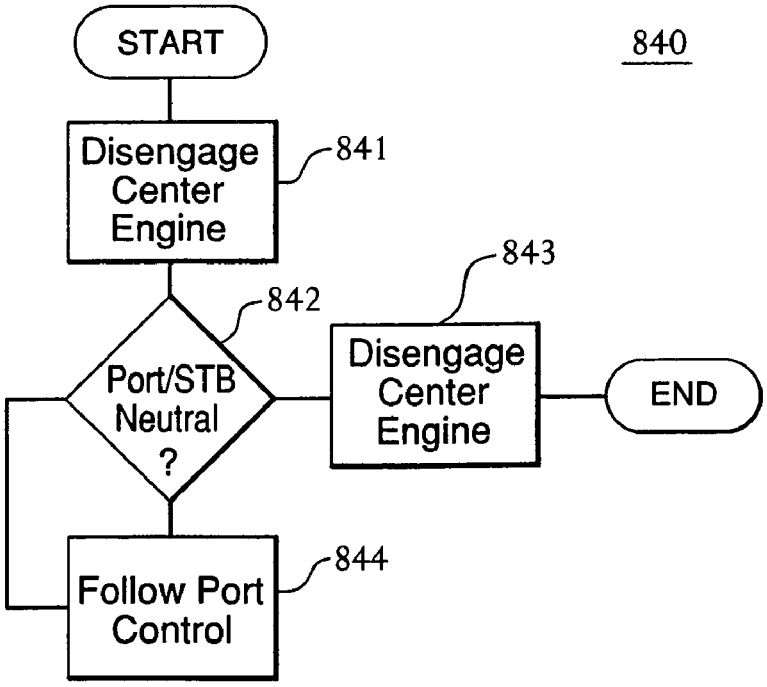

In a fourth docking mode 840, as depicted in FIG. 8D, the center ECU causes the center engine to disengage at startup (step 841). If, at step 842, the center ECU detects that either the port or starboard transmission is in neutral, then, at step 843, the center ECU causes the center engine to disengage. Otherwise, at step 844, the center ECU causes the center engine to follow the port lever for shift and throttle position.

To implement the above-described docking modes, it is, therefore, desirable for the center engine to be provided with the current gear of the port transmission, the current gear of the starboard transmission, the current throttle and RPM of the port engine, the current throttle and RPM of the starboard engine, and the sync mode state. The center ECU also preferably has defaults settings for, and the capability of receiving data pertaining to, gear operation mode (for non-sync operation), throttle source, and sync mode. Gear operation modes may include: follow port ECU, follow starboard ECU, follow both ECUs, and disable servo. Throttle source includes: follow port ECU, follow starboard ECU, and disable servo. Sync mode may include: follow port ECU and follow master ECU.

In a preferred embodiment of a four engine installation, the center port ECU causes the center port engine to follow the port lever for shift and throttle position, and the center starboard engine to follow the starboard lever for shift and throttle position.

A control system according to the invention may also include the capability for selective disengagement of one or more engines. That is, the control system enables an operator to disengage one or more engines (e.g., by causing the engine(s) to go to idle) and/or one or more transmissions (e.g., by causing the transmission(s) to go to neutral).

Figure 9A:
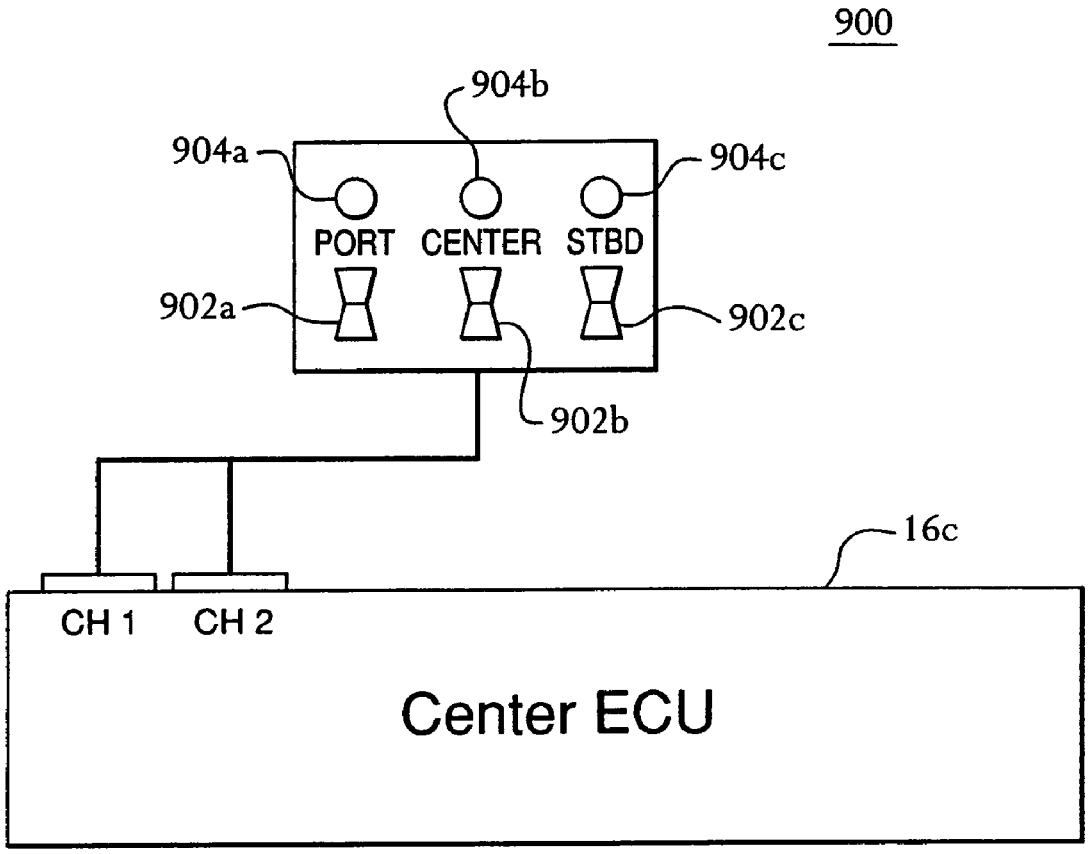
FIG. 9 depicts an engine control panel according to an aspect of the invention.
Figure 9B:
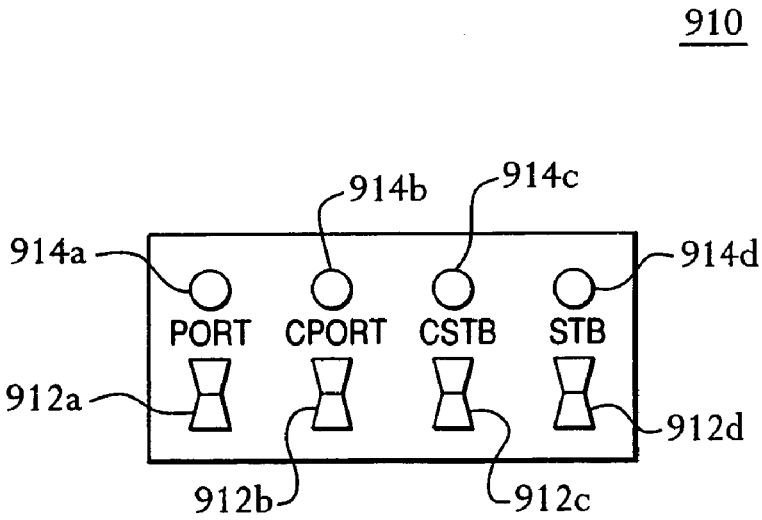

Preferably, an engine control panel (ECP) is provided to enable selective engagement/disengagement. A preferred embodiment of an ECP is depicted in FIG. 9. As shown, an ECP according to the invention may include a set of one or more toggle switches or other mechanisms via which the operator can cause the ECU to disengage one or more engines. As depicted in FIG. 9A, the ECP 900 includes a respective switch 902*a–c* for each of three engines—port, center, and starboard. The switches 902*a–c* may be momentary switches or toggle switches. It should be understood that a respective switch may be provided for each of any number of engines. FIG. 9B depicts a preferred embodiment of an ECP 910 that includes a respective switch 912*a–d* for each of four engines—port, center port, center starboard, and starboard.

The ECP 900, 910 may also include a set of one or more indicators 904*a–c*, 914*a–d*, such as LEDs, for example. Each indicator indicates whether an associated engine is engaged or disengaged. Note that a toggle switch may be both a mechanism for engaging/disengaging an engine and an indicator of whether the engine is currently engaged or disengaged. It should be understood that momentary switches are preferred to avoid the confusion of an indicator being misaligned with a switch position (e.g., in installations having more than one control station).

Activating a switch will engage the engine, allowing the shift and throttle functions to be performed. When an engine is engaged, the status indicator will light. Deactivating the switch will cause the engine/transmission to be brought to neutral idle, and the ECU for that engine will stop responding to the control lever. When engine engagement is requested, the engagement indicator will allow the operator to know if the engine engaged. If the current throttle is below five percent of full throttle, the engine will engage. If, however, the current throttle is above five percent of full throttle, the indicator will blink on and then off once. This will inform the operator that the throttle is too high or that the ECU is otherwise unable to engage the servos.

In a three engine installation, the ECP 910 is preferably coupled to the center ECU 16*c* (see FIG. 9A), though it should be understood that, in general, the ECP could be coupled to any or all of the ECUs. Activation of an engagement/disengagement switch causes an engage/disengage signal to be transmitted from the ECP 910 to the center ECU 16*c*. The center ECU 16*c* determines from the engage/disengage signal which engine has been selected for engagement/disengagement. If the engage/disengage switch associated with an engine other than the center engine was selected, the center ECU sends over the communications link an engage/disengage command addressed to the ECU associated with the engine selected to be engaged/disengaged. The ECU associated with the engine to be engaged/disengaged engages/disengages the shift and throttle servos (e.g., the servos are preferably moved to neutral and idle).

Preferably, each ECU periodically sends a message on the bus that indicates whether its associated engine is engaged or disengaged. The ECU that is coupled to the ECP (i.e., the "ECP ECU") determines from these messages which engines are engaged and which are disengaged. The ECP ECU can then control the engagement indicators on the ECP (e.g. by sending an appropriate voltage to the ECP for each LED). Preferably, the indicators are turned on if the engine is engaged and off if the engine is disengaged. Similarly, if the ECU is unable to engage/disengage the engine as commanded, an error message is returned to the ECP ECU. In response, the ECP ECU causes the appropriate indicator to indicate that the engagement/disengagement could not be performed (e.g., by flashing the associated indicator lamp).

It should be understood that the above-described techniques may also be used to enable selective engagement/disengagement in an installation having more than three engines. For example, in a four engine installation, the ECP is preferably coupled to the center port or center starboard ECU.

Preferably, if an engine is disengaged, the ECU associated with the disengaged engine continues to communicate with the other ECUs. Thus, any combination of engines may be disengaged, yet the system can still control any engines that are engaged. For example, if the port and starboard engines are disengaged, but the center engine is not, the port ECU may be adapted to continue to send shift and throttle commands based on the current position of the port control lever so that the center ECU will receive those commands and continue to control the center engine. In essence, therefore, even if an ECU is not performing its control function (i.e., controlling the shift and throttle of its associated power train), it may still perform its communication function. As such, it should be understood that the communication and control functions of an ECU are logically separate and could be physically separated as well (e.g., a system could include an engine control unit that performs control over an engine and a separate communications unit that communicates with one or more ECUs.

Thus, there have been described control systems for marine vessels in accordance with the invention. Those skilled in the art will appreciate that numerous changes and modifications may be made to the preferred embodiments of the invention and that such changes and modifications may be made without departing from the spirit of the invention. For example, it is contemplated that the components of an ECU may be integrated into the control head. That is, the control head may include a microcontroller, thereby obviating the need for the electrical connections between the control head and the ECU. In such an embodiment, the communications link couples the control heads directly to one another. In another contemplated embodiment, any of the ECUs, actuators, engines, transmissions, etc., could be CANBus nodes. In such an embodiment, an ECU may be coupled to each of the other nodes via a communications link as described above. It is therefore intended that the appended claims cover all such equivalent variations as fall within the true spirit and scope of the invention.

What is claimed is:

1. A control system for a marine vessel having first, second, and third marine engines, the control system comprising:

a first control lever having an associated operating range;

a second control lever having an associated operating range;

a first engine control unit (ECU) electrically coupled to the first control lever, a first transmission, and the first engine;

a second ECU electrically coupled to the second control lever, a second transmission, and the second engine; and a third ECU communicatively coupled to the first and second ECUs and electrically coupled to, a third transmission, and the third engine;

wherein each of the engines adjusts a respective throttle in response to a movement of at least one of the control levers within its associated operating range, wherein the first ECU controls the first transmission and the throttle of the first engine based on a position of the first control lever within its operating range, the second ECU controls the second transmission and the throttle of the second engine based on a position of the second control lever within its operating range, and the third ECU controls the throttle of the third engine based on at least one of the position of the first control lever and the position of the second control lever and controls the third transmission based on the position of the first control lever and the position of the second control lever, wherein at least one of the engines is an electronically-controlled engine, and wherein the ECU that is coupled to the electronically-controlled engine controls the throttle of the electronically-controlled engine by providing at least one of an analog voltage signal and a digital data packet to the electronically-controlled engine.

2. A control system for a marine vessel having first, second, and third marine engines, the control system comprising:

a first control lever having an associated operating range;

a second control lever having an associated operating range;

a first engine control unit (ECU) electrically coupled to the first control lever and the first transmission;

a second ECU electrically coupled to the second control lever and the second transmission; and a third ECU communicatively coupled to the first and second ECUs and electrically coupled to the third transmission, wherein each of the engines adjusts a respective throttle in response to a movement of at least one of the control levers within its associated operating range, wherein the marine vessel has first, second, and third transmissions, and wherein each of the transmissions adjusts a respective shift position in response to a movement of at least one of the control levers within its associated operating range, wherein the first ECU controls the shift position of the first transmission based on a position of the first control lever within its operating range, the second ECU controls the shift position of the second transmission based on a position of the second control lever within its operating range, and the third ECU controls the shift position of the third transmission based on the position of the first control lever and the position of the second control lever wherein at least one of the transmissions is an electronically-controlled transmission, and wherein the ECU that is coupled to the electronically-controlled transmission controls the shift position of the electronically-controlled transmission by providing at least one of an analog voltage signal and a digital data packet to the electronically-controlled transmission.

3. A method for controlling a marine vessel, the method comprising:

determining a first gear position associated with a first transmission;

determining a second gear position associated with a second transmission; and controlling a third transmission based on the first and second gear positions.

4. The method of claim 3, wherein controlling the third transmission comprises causing the third transmission to be set to a neutral position if the first gear position is different from the second gear position.

5. The method of claim 4, further comprising causing an engine associated with the third transmission to be set to an idle throttle.

6. The method of claim 3, wherein controlling the third transmission comprises disengaging the third transmission if the first transmission is in a forward position and the second transmission is in a reverse position.

7. The method of claim 3, wherein controlling the third transmission comprises causing the third transmission to be set to a gear position that is the same as the first gear position.

8. The method of claim 3, further comprising:

determining a throttle position of an engine associated with the first transmission; and causing an engine associated with the third transmission to be set to a throttle position that is the same as the throttle position of the engine associated with the first transmission.

9. The method of claim 3, wherein controlling the third transmission comprises causing the third transmission to be set to a reverse position and setting a throttle of an engine associated with the third transmission to a throttle that is the same as a throttle to which an engine associated with the second transmission is set, if the first transmission is in a forward position and the second transmission is in a reverse position.

10. The method of claim 3, further comprising:

causing the third transmission to be set to a gear position that is the same as the first gear position and setting the throttle of the engine associated with the third transmission to a throttle that is the same as a throttle to which an engine associated with the first transmission is set, unless the first transmission is in a forward position and the second transmission is in a reverse position.

11. The method of claim 3, wherein controlling the third transmission comprises disengaging the third transmission if either the first or second gear position is a neutral position.

12. The method of claim 3, further comprising:

receiving a docking mode indicator that identifies a manner for controlling the third transmission based on the first and second gear positions.

* * * * *